US012440017B2

(12) United States Patent
Higgins

(10) Patent No.: US 12,440,017 B2
(45) Date of Patent: Oct. 14, 2025

(54) PORTABLE CHAIR

(71) Applicant: Joseph Carl Rogers Higgins, Plymouth, MN (US)

(72) Inventor: Joseph Carl Rogers Higgins, Plymouth, MN (US)

( * ) Notice: Subject to any disclaimer, the term of this patent is extended or adjusted under 35 U.S.C. 154(b) by 107 days.

(21) Appl. No.: 18/408,025

(22) Filed: Jan. 9, 2024

(65) Prior Publication Data

US 2024/0225248 A1 Jul. 11, 2024

Related U.S. Application Data

(60) Provisional application No. 63/438,155, filed on Jan. 10, 2023.

(51) Int. Cl.
*A45F 4/02* (2006.01)
*A45F 3/04* (2006.01)
*A47C 4/52* (2006.01)

(52) U.S. Cl.
CPC ..... *A45F 4/02* (2013.01); *A45F 3/04* (2013.01); *A47C 4/52* (2013.01); *A45F 2004/026* (2013.01)

(58) Field of Classification Search
CPC ..... A45F 2003/003; A45F 2003/045; A45F 2004/006; A45F 2004/023; A45F 2004/026; A45F 3/04; A45F 3/08; A45F 3/10; A45F 4/00; A45F 4/02; A47C 4/52; A47C 9/10
USPC ..... 224/155
See application file for complete search history.

(56) References Cited

U.S. PATENT DOCUMENTS

| | | | | |
|---|---|---|---|---|
| 5,595,429 | A * | 1/1997 | Kennedy | A47B 83/045 224/155 |
| 6,938,761 | B2 * | 9/2005 | Nish | A45F 3/04 224/652 |
| 7,604,288 | B1 * | 10/2009 | Verhulst | A47C 13/00 297/129 |
| 7,832,663 | B1 * | 11/2010 | Cotham | A01C 15/02 239/152 |
| 8,066,206 | B1 * | 11/2011 | Cotham | A01K 5/0225 239/152 |
| 8,251,269 | B2 * | 8/2012 | Winneur | A45C 9/00 224/652 |
| 10,779,634 | B1 * | 9/2020 | Kawamoto | A45F 3/04 |
| 11,147,255 | B1 * | 10/2021 | Snyder | A01K 97/22 |
| 12,207,637 | B1 * | 1/2025 | Anderson | A01K 97/20 |
| 2007/0205234 | A1 * | 9/2007 | Lessmann | A45F 4/02 224/652 |

(Continued)

*Primary Examiner* — Nathan J Newhouse
*Assistant Examiner* — Matthew T Theis
(74) *Attorney, Agent, or Firm* — Merchant & Gould P.C.

(57) ABSTRACT

A portable chair featuring a unique combination of elements for enhanced utility and comfort. The chair includes a sealable five-gallon plastic bucket with a lid, encased in an insulated fabric sheath with a bottom panel and an annular wall panel forming a cavity for the bucket. A pivotal seat portion is attached to the bucket's lid, which includes a rigid panel with a threaded aperture, a seat pad, and a fabric panel enveloping the seat pad. The seat pivots via a threaded fastener passing through the lid's aperture. Additionally, the chair is equipped with shoulder straps and an adjustable padded hip belt. The chair features a pair of rigid telescoping poles, configurable in extended or storage positions, which allows the chair to transition from a compact, backpack-like configuration to a functional seating arrangement, meeting both storage and comfort needs.

20 Claims, 13 Drawing Sheets

(56) References Cited

U.S. PATENT DOCUMENTS

2017/0311703 A1* 11/2017 Wistrand ..... A45F 3/08

* cited by examiner

PORTABLE CHAIR

CROSS-REFERENCE TO RELATED APPLICATION

This application claims the benefit of U.S. Provisional Application No. 63/438,155, filed Jan. 10, 2023, the disclosure of which is hereby incorporated herein by reference.

BACKGROUND

The advent of outdoor recreational activities, such as sporting events, hunting, and fishing, has perpetuated the need for equipment that is both functional and portable. Participants in these activities often find themselves in remote or natural settings where the availability of seating and storage facilities is minimal or entirely absent. The challenge is twofold: first, there is the necessity to carry various equipment, supplies, and personal items to the site, which demands a portable and ergonomic solution; second, once at the location, the need for a comfortable and stable seating arrangement becomes paramount. Traditional solutions, like separate chairs and backpacks, are often cumbersome, requiring individuals to carry multiple items, thus increasing the load and complicating mobility in outdoor settings.

SUMMARY

Aspects of the present disclosure relate to a portable chair, including a sealable plastic five gallon bucket including a lid, an insulated fabric sheath comprising a bottom panel and an annular wall panel cooperating to form a cavity to receive the five gallon bucket, a seat portion pivotably coupleable to the lid of the five gallon bucket, the seat portion comprising a rigid panel including a centrally located threaded aperture, a seat pad, and a fabric panel at least partially enveloping the seat pad coupled to the rigid panel, wherein a threaded fastener passes through an aperture defined in the lid of the five gallon bucket for receipt in the threaded aperture of the rigid panel, thereby enabling the seat portion to pivot relative to the lid of the five gallon bucket, a pair of shoulder straps operably coupled between an upper perimeter of the annular wall and a lower portion of the annular wall, an adjustable length padded hip belt selectively coupleable to the annular wall panel via one or more fasteners, wherein the padded hip belt comprises a first pair of telescoping pole receiving pockets, each of the first pair of telescoping pole receiving pockets including a first telescoping pole receiving panel having a surface positioned against an exterior surface of the padded hip belt, and a second telescoping pole receiving panel operably coupled to the exterior surface of the padded hip belt about at least a portion of its peripheral edge to define each of the first pair telescoping pole receiving pockets, a second pair of telescoping pole receiving pockets operably coupled to the annular wall, each of the pair of second telescoping pole receiving pockets including a first telescoping pole receiving panel having a surface positioned against an exterior surface of the annular wall, and a second telescoping pole receiving panel operably coupled to the exterior surface of the annular wall about at least a portion of a peripheral edge of the second telescoping pole receiving panel to define the second pair of telescoping pole receiving pockets, and a pair of rigid telescoping poles, each of the pair of rigid telescoping poles including a first member and a second member selectively coupleable together in at least one of an extended configuration and a storage configuration via a spring biased bayonet pin coupling, wherein the portable chair is transitionable from a storage position in which the adjustable length padded hip belt is coupled to the annular wall panel via the one or more fasteners and the pair of rigid telescoping poles are in the storage configuration positioned within the second pair of telescoping pole receiving pockets, to an in use position in which the pair of rigid telescoping pools are extended to the extended configuration, and the adjustable length padded hip belt is decoupled from the annular wall panel, and the ends of the respective pair of rigid telescoping poles are positioned within the first pair of telescoping pole receiving pockets.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Reference will now be made in detail to exemplary aspects of the present disclosure that are illustrated in the accompanying drawings. Wherever possible, the same reference numbers will be used throughout the drawings to refer to the same or like parts.

Figure 10:
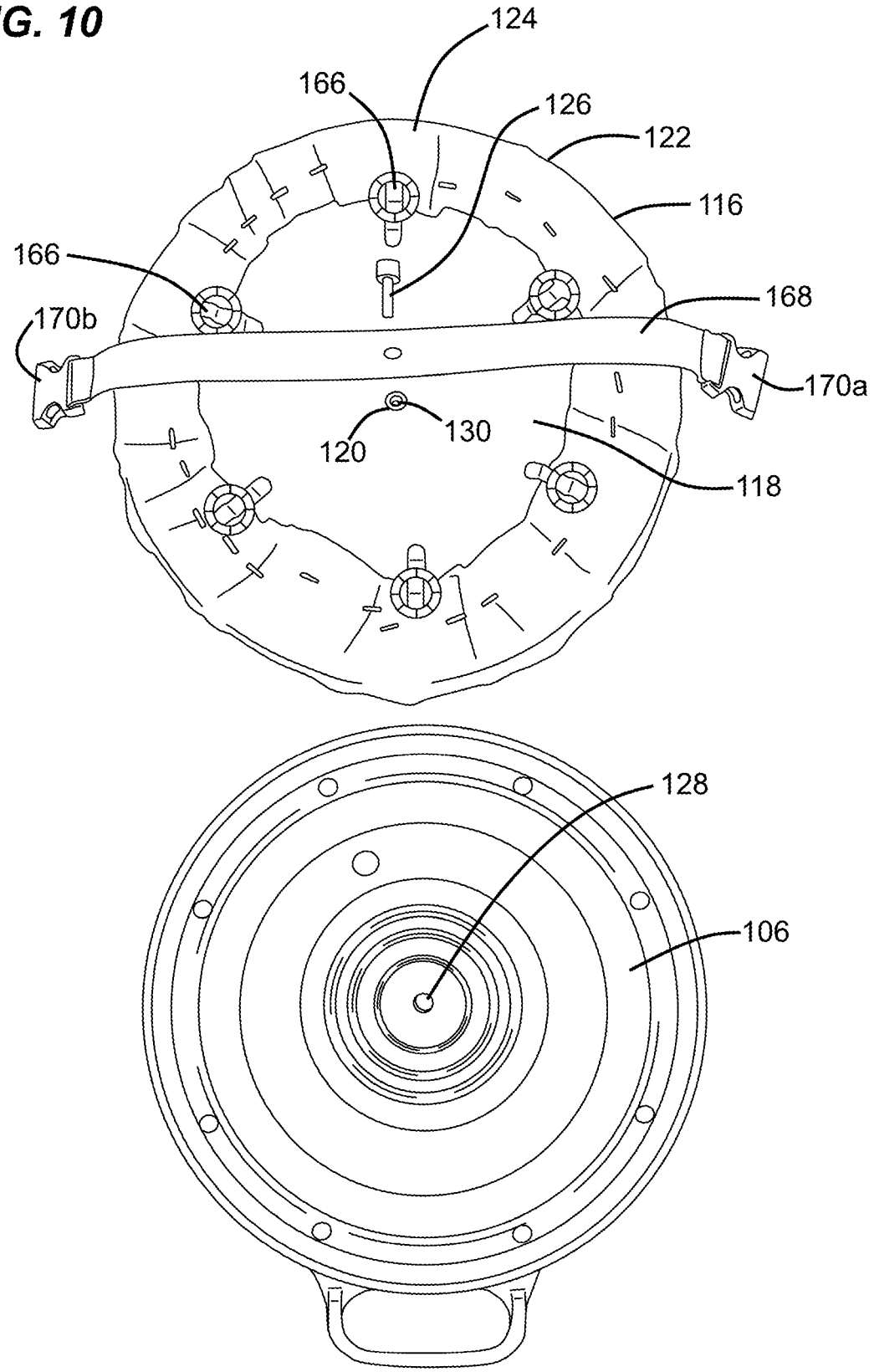
FIG. 10 is a partially disassembled view depicting a seat portion and bucket lid, in accordance with an embodiment of the disclosure.

Referring to FIGS. 1-4, a portable chair 100 is depicted in accordance with an embodiment of the disclosure. With additional reference to FIG. 5, in embodiments, the portable chair 100 can include a sealable plastic five gallon bucket 104, including a lid 106 (as depicted in FIG. 10). In other embodiments, the bucket 104 can be of a variety of shapes and sizes (e.g., 3.5 gal., 4, gal., 4.25 gal, 5 gal, 5.25 gal, 6 gal, 6.5 gal, 7 gal. etc.). In embodiments, the portable chair 100 can include an insulated fabric sheath 108, comprising a bottom panel 110, and an annular wall panel 112 cooperating to form a cavity 114 to receive the five gallon bucket 104. In some embodiments, the annular wall panel 112 can be thermally insulated (e.g., include a layer of foam insulation, etc.). In some embodiments, the fabric used to construct the insulated fabric sheath can be printed in a woodland camouflage pattern; although other colors and patterns are also contemplated. In some embodiments, the fabric used to construct the insulated fabric sheath can be water resistant.

With additional reference to FIG. 10, in embodiments, the portable chair 100 can include a seat portion 116 pivotably coupleable to the lid 106 of the five gallon bucket 104. In one embodiment, the seat portion 116 can include a rigid panel 118 including a centrally located threaded aperture 120, a seat pad 122, and a fabric panel 124 at least partially enveloping the seat pad 122, and coupled to the rigid panel 118. In one embodiment, a threaded fastener 126 can pass through an aperture 128 defined in the lid 106 of the five gallon bucket 104 for receipt in the threaded aperture 130 of the rigid panel 118, thereby enabling the seat portion 116 to pivot relative to the lid 106 of the five gallon bucket 104.

In one embodiment, the seat portion 116 includes a plurality of sliders 166 positioned annularly around the threaded aperture 130 of the rigid panel 118 configured to enable ease in pivoting of the seat portion 116 relative to the lid 106 of the five gallon bucket 104. In one embodiment, the seat portion 116 can include a seat portion securement strap 168 enabling the seat portion to be selectively coupled to the annular wall portion. In one embodiment, the seat portion securement strap includes a first fastener 170A and a second fastener 170B positioned at a respective first end and second end of the seat portion securement strap 168, which can be configured to operably couple with one or more fastener 171 attached to the annular wall panel 112. In one embodiment, the threaded fastener 126 passes through a portion of the seat portion securement strap 168 between the first end and the second end of the seat portion securement strap 168.

Figure 1:
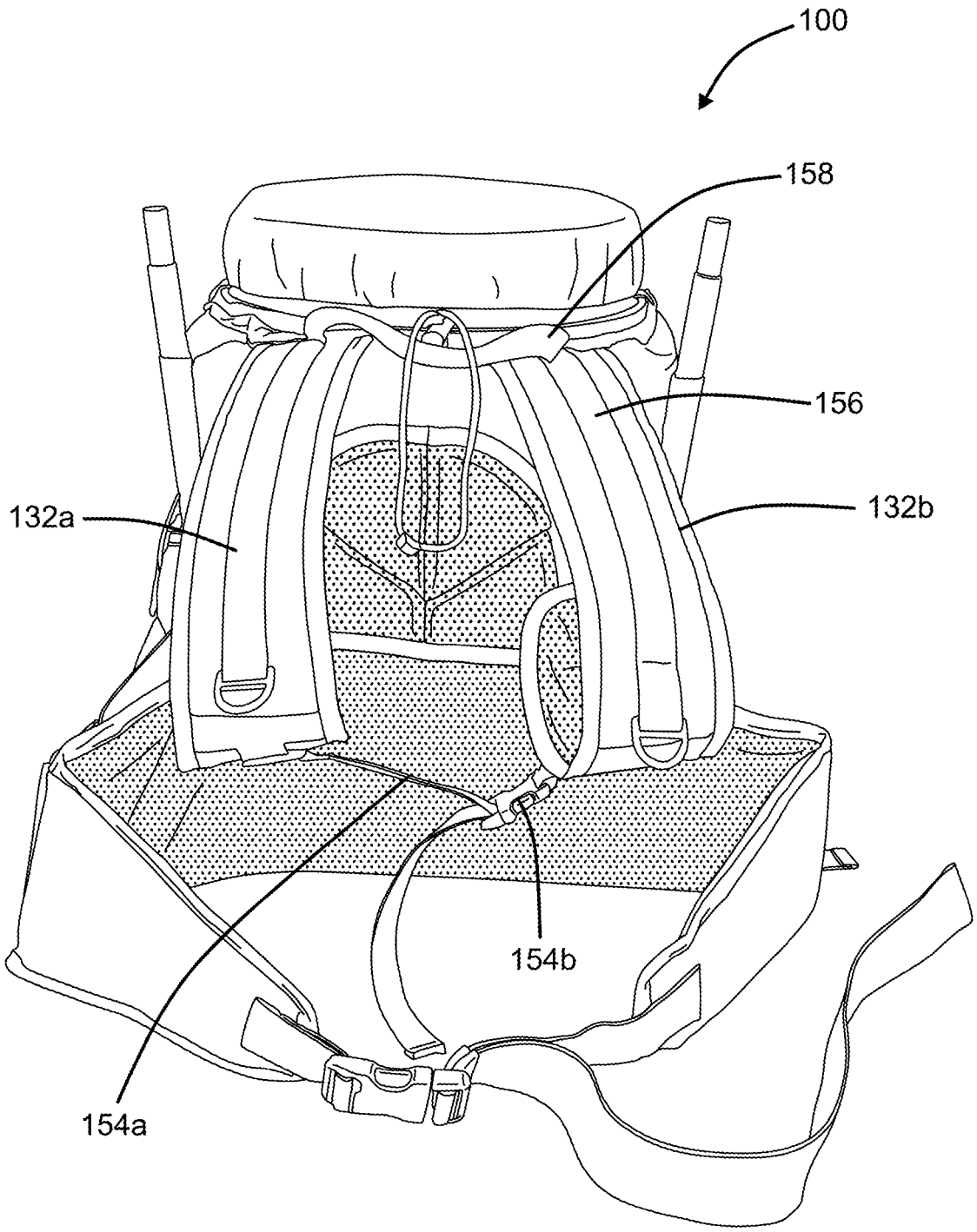
FIG. 1 is a perspective view depicting a portable chair in a storage configuration, in accordance with an embodiment of the disclosure.
Figure 5:
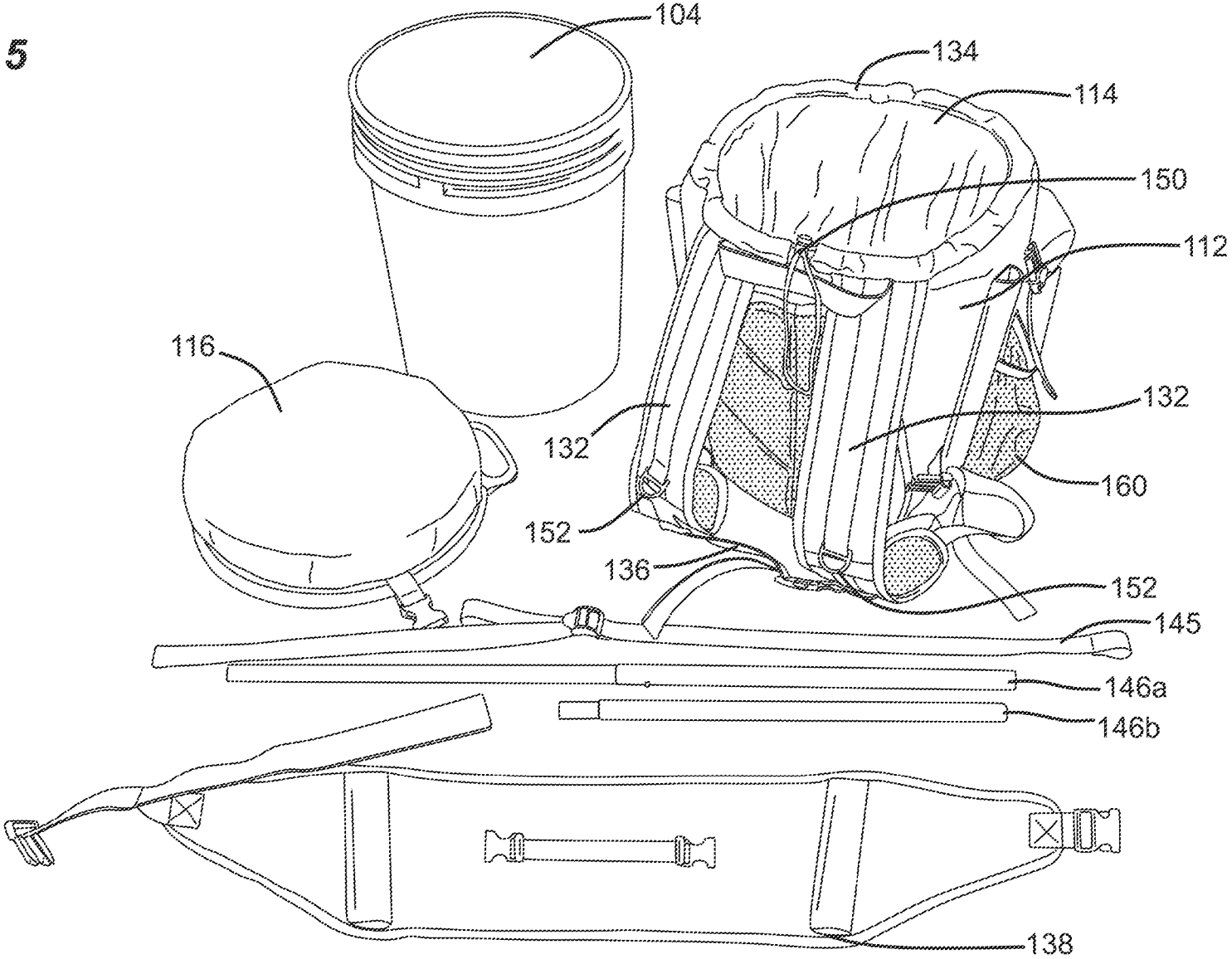
FIG. 5 is a perspective view depicting various components of a portable chair, in accordance with an embodiment of the disclosure.

With continued reference to FIG. 5, in embodiments, the portable chair 100 can include a pair of shoulder straps 132 operably coupled between an upper perimeter 134 of the annular wall panel 112 and a lower portion 136 of the annular wall panel 112. In one embodiment, each of the shoulder straps 132 has a width of at least about 3 inches (about 7.5 cm). In one embodiment, the shoulder straps 132 are adjustable in length. In one embodiment, at least one of the pair of shoulder straps 132 includes a D ring 152 for selective gear attachment. As depicted in FIG. 1, in one embodiment, the portable chair 100 can include an adjustable length chest strap 154A/B including a first portion 154A operably coupled to a first shoulder strap 132A of the pair of shoulder straps, and a second portion 154B operably coupled to a second shoulder strap 132B of the pair of shoulder straps, such that the first portion 154A is selectively coupleable to the second portion 154B.

Figure 6:
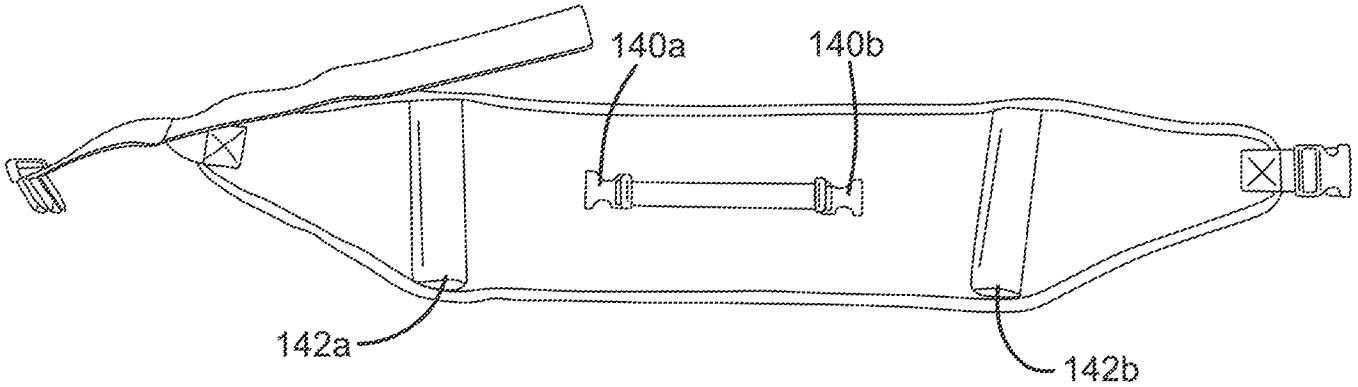
FIG. 6 is a profile view depicting a first side of an adjustable length padded hip belt, in accordance with an embodiment of the disclosure.
Figure 7:
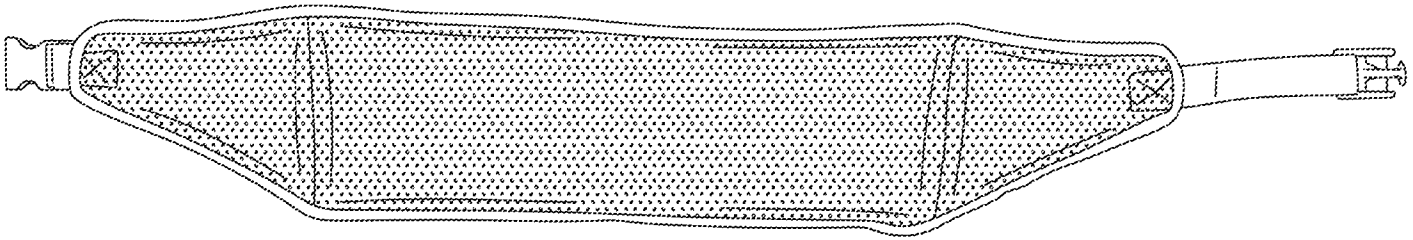
FIG. 7 is a profile view depicting a second side of the adjustable length padded hip belt of FIG. 6, in accordance with an embodiment of the disclosure.

With additional reference to FIGS. 6 and 7, in embodiments, the portable chair 100 can include an adjustable length padded hip belt 138 selectively coupleable to the annular wall panel 112 via one or more fasteners 140A/B. In one embodiment, the padded hip belt 138 can have a width of at least about 6 inches (about 15 cm). In one embodiment, the padded hip belt 138 can be configured to clip to portions of the portable chair 100, so as to be releasably connected to the annular wall panel 112

Figure 12:
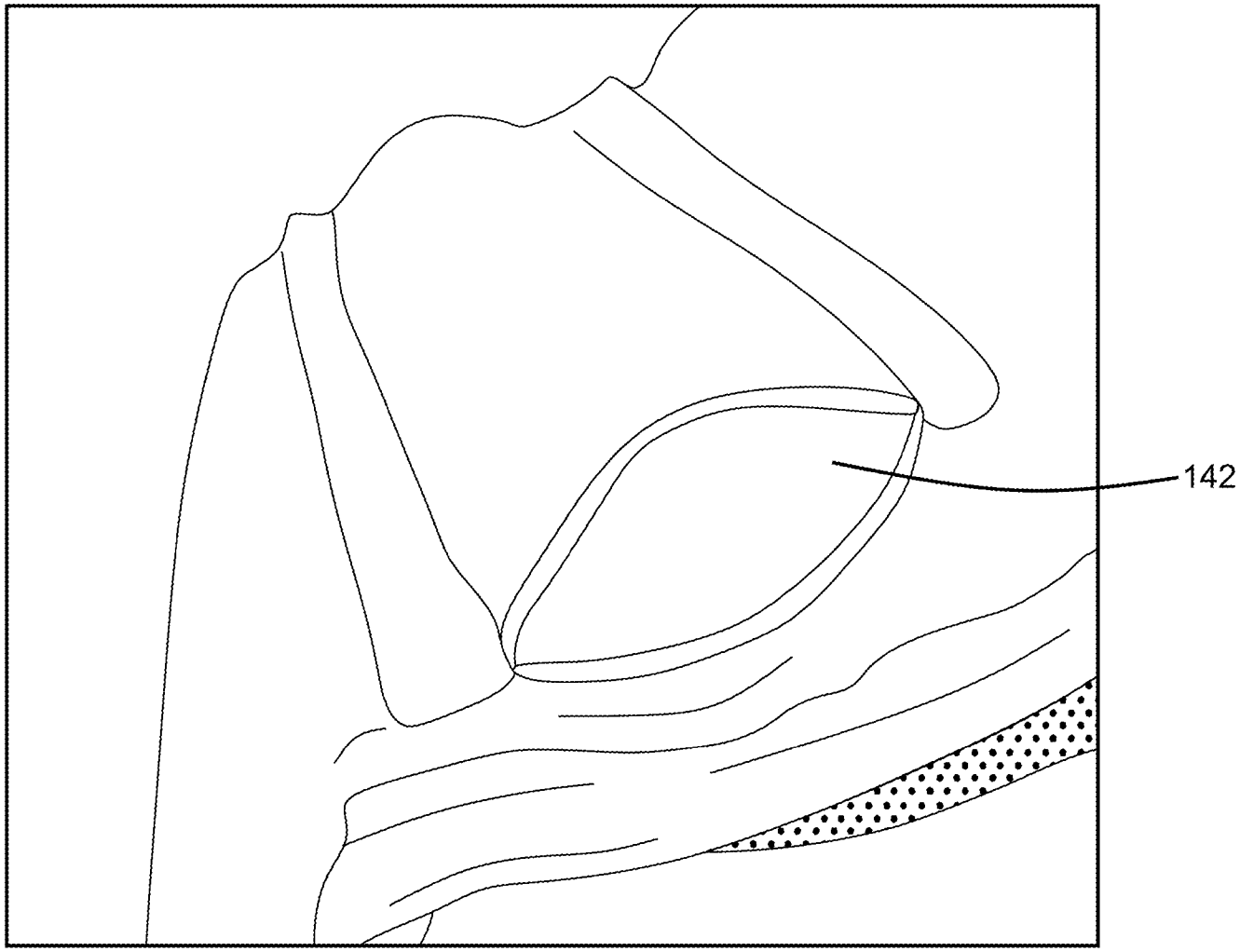
FIG. 12 is a close-up view depicting a telescoping pole receiving pocket of an adjustable length padded hip belt, in accordance with an embodiment of the disclosure.

In one embodiment, the padded hip belt 138 can include a first pair of telescoping pole receiving pockets 142A/B. As best depicted in FIG. 12, in one embodiment, each of the first pair of telescoping pole receiving pockets 142A/B can include a first telescoping pole receiving panel having a surface positioned against an exterior surface of the padded hip belt 138, and a second telescoping pole receiving panel operably coupled to the exterior surface of the padded hip belt 138 about at least a portion of its peripheral edge to define each of the first pair telescoping pole receiving pockets 142A/B. In one embodiment, each of the first pair of telescoping pole receiving pockets 142A/B has a depth of at least about 5 inches (about 12.5 cm).

Figure 3:
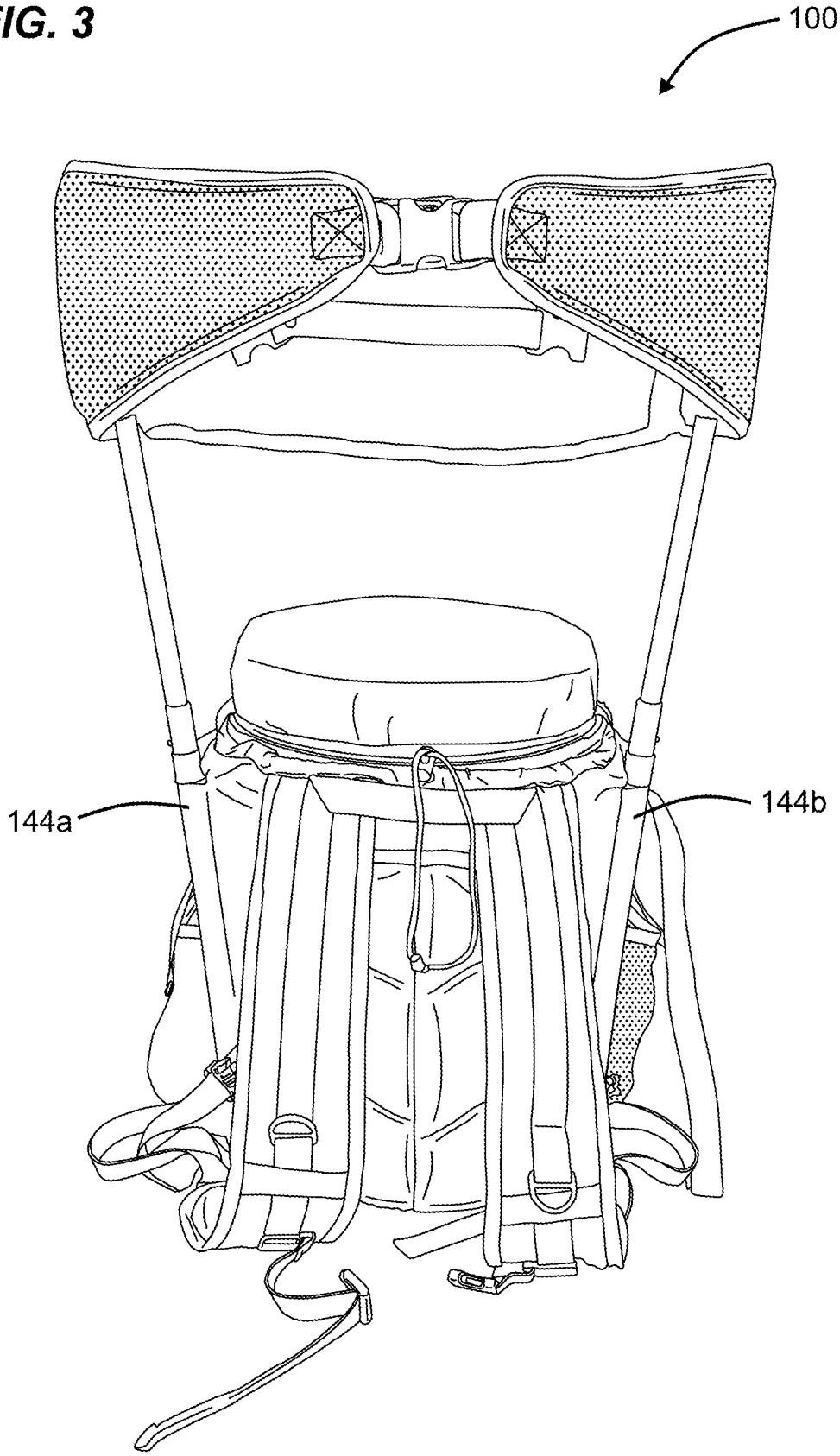
FIG. 3 is a perspective view depicting the portable chair of FIG. 1 in an in use configuration, in accordance with an embodiment of the disclosure.

In embodiments, the portable chair 100 can include a second pair of telescoping pole receiving pockets 144A/B (as depicted in FIG. 3) operably coupled to the annular wall panel 112. In one embodiment, each of the pair of second telescoping pole receiving pockets 144A/B can include a first telescoping pole receiving panel having a surface positioned against an exterior surface of the annular wall panel 112, and a second telescoping pole receiving panel operably coupled to the exterior surface of the annular wall panel 112 about at least a portion of a peripheral edge of the second telescoping pole receiving panel to define the second pair of telescoping pole receiving pockets. In embodiments, each of the second pair of telescoping pole receiving pockets 144A/B can have a depth of at least about 12 inches (about 30 cm).

Figure 14:
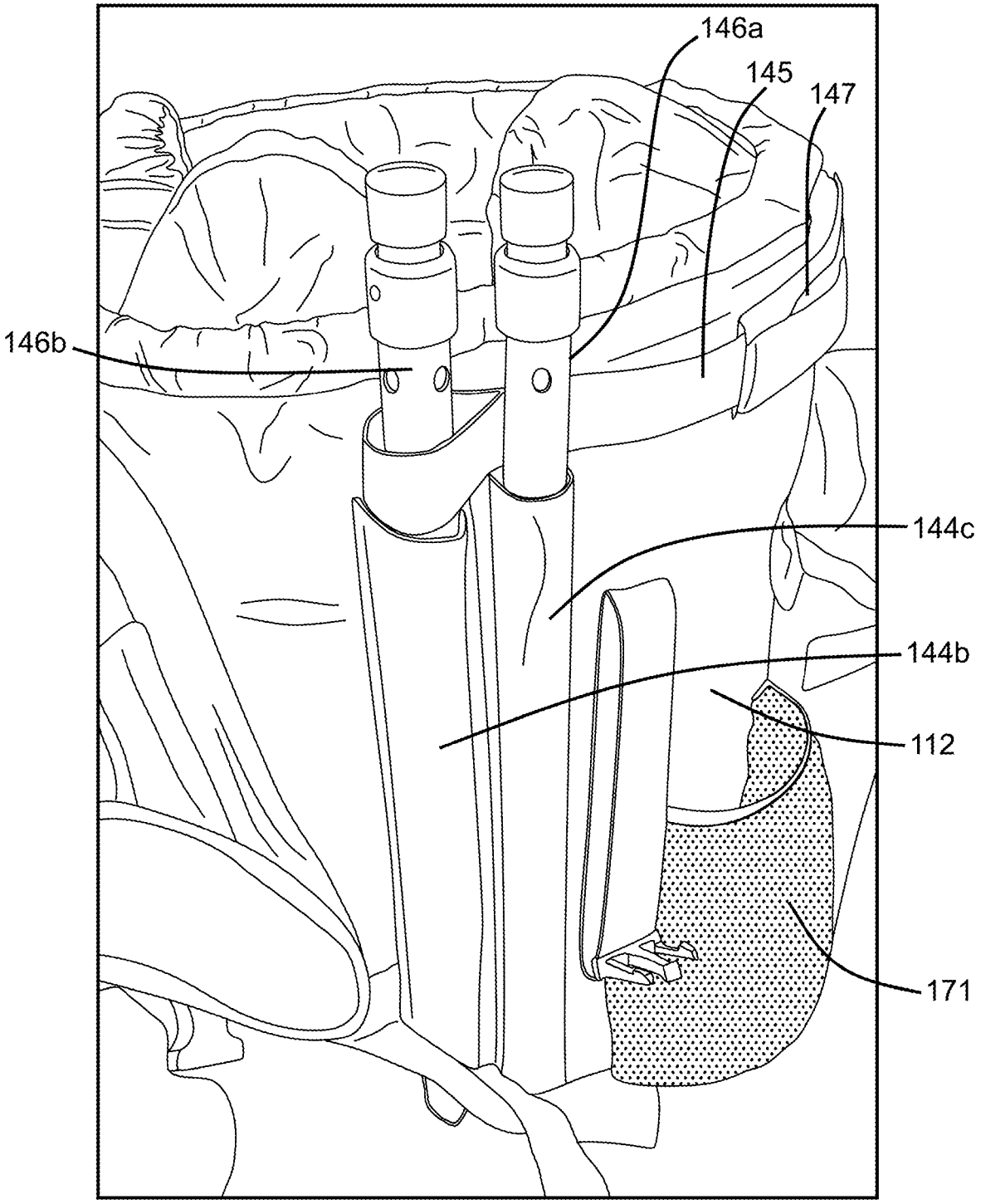
FIG. 14 is a perspective view depicting a portable chair including an annular wall panel portion defining a third telescoping pole securement strap sleeve, in accordance with an embodiment of the disclosure.

As further depicted in FIG. 14, in some embodiments, the portable chair 100 can include a third telescoping pole receiving pocket 144C, which in embodiments can be positioned adjacent to one of the pair of telescoping pole receiving pockets 144A/B (FIG. 14 depicts the third telescoping pole receiving pocket 144C as being adjacent to the second telescoping pole receiving pocket 144B). In embodiments, the third telescoping pole receiving pocket 144C can be used for storage of one of the rigid telescoping poles 146A/B, or for adjustment of the distance between the rigid telescoping poles 146A/B when the portable chair 100 is in the seat configuration.

Figure 8:
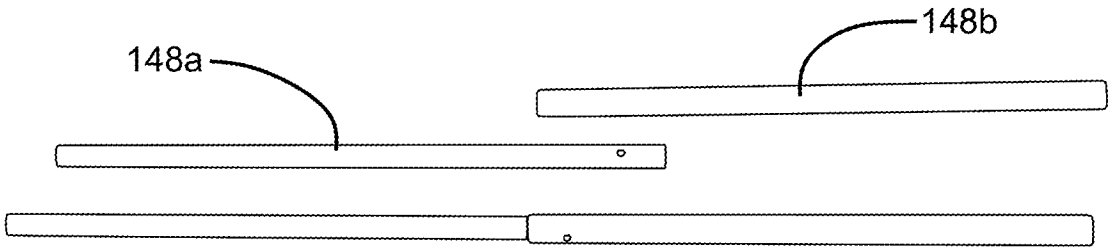
FIG. 8 is a profile view depicting a pair of rigid telescoping poles, in accordance with an embodiment of the disclosure.
Figure 9:
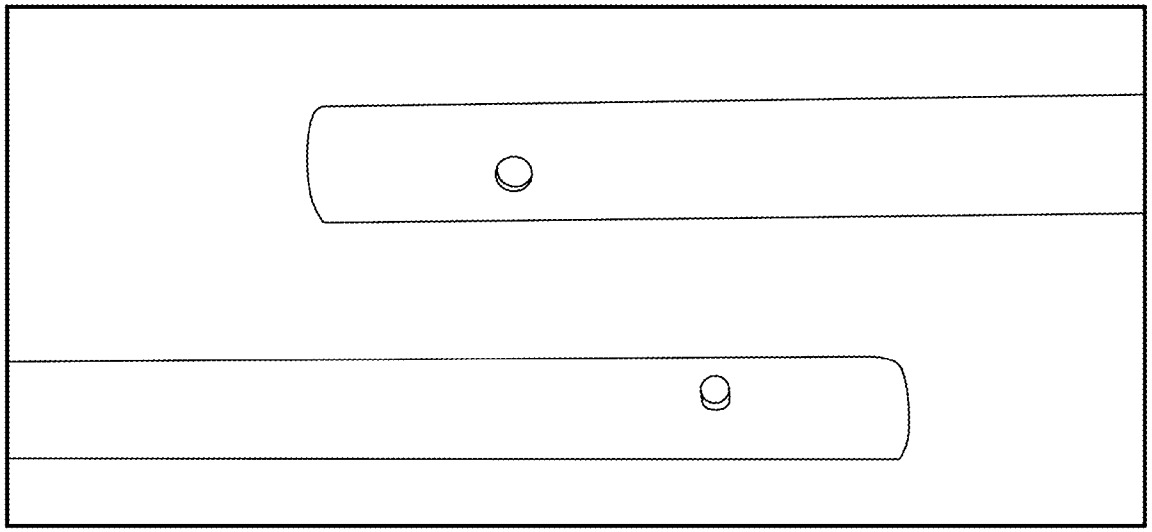
FIG. 9 is a close-up profile view depicting a spring based bayonet pin coupling of a rigid telescoping pole, in accordance with an embodiment of the disclosure.
Figure 11:
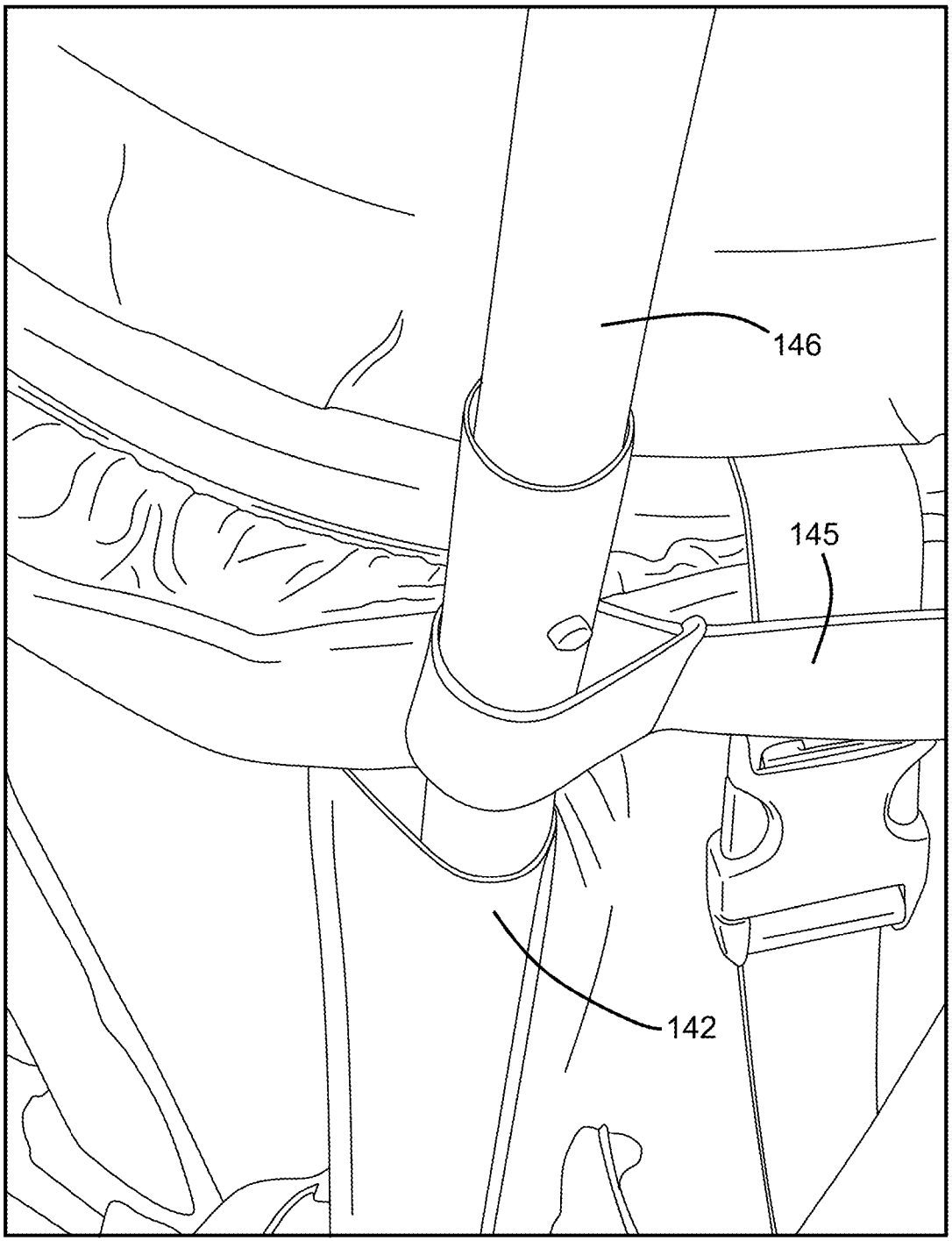
FIG. 11 is a perspective view depicting a rigid telescoping pole position within a telescoping pole receiving pocket, and secured in place at least partially by a telescoping pole securement strap, in accordance with an embodiment of the disclosure.
Figure 13:
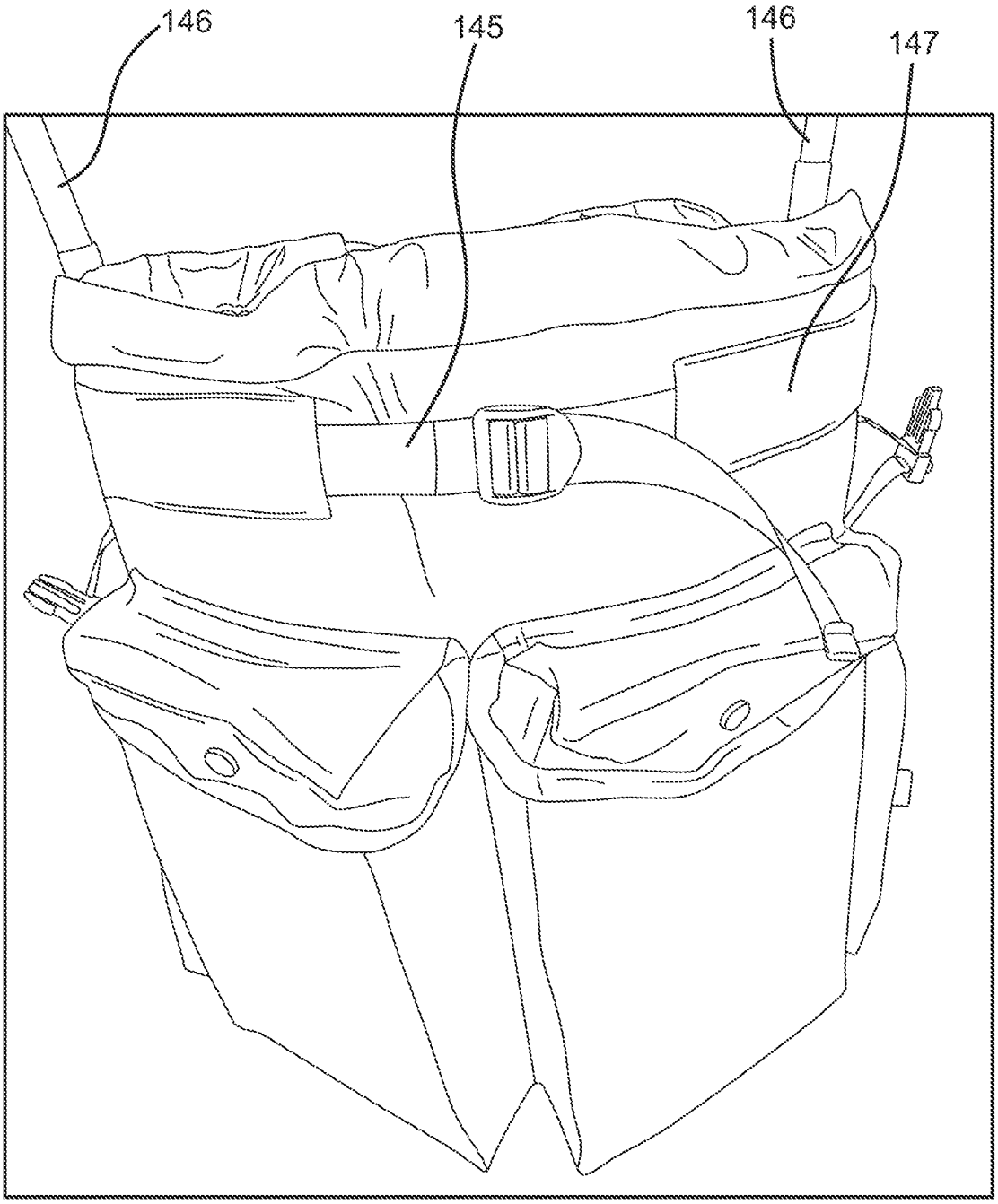
FIG. 13 is a perspective view depicting a portable chair including a telescoping pole securement strap passing at least partially through a telescoping pole securement strap sleeve in an in use configuration, in accordance with an embodiment of the disclosure.

With continued reference to FIG. 5, in embodiments, the portable chair 100 can include a pair of rigid telescoping poles 146A/B. With additional reference to FIGS. 8 and 9, in one embodiment, each of the pair of rigid telescoping poles 146A/B can include a first member 148A and a second member 148B selectively coupleable together in at least one of an extended configuration (as depicted in FIG. 8) and a storage configuration via a spring biased bayonet pin coupling. With additional reference to FIG. 11, in some embodiments, the portable chair 100 can include a telescoping pole securement strap 145, which can be configured to provide tensile retention between the pair of rigid telescoping poles 146A/B in some configurations. In some embodiments, the telescoping pole securement strap 145 can pass at least partially through a telescoping pole securement strap sleeve 147 (as depicted in FIG. 13).

Figure 2:
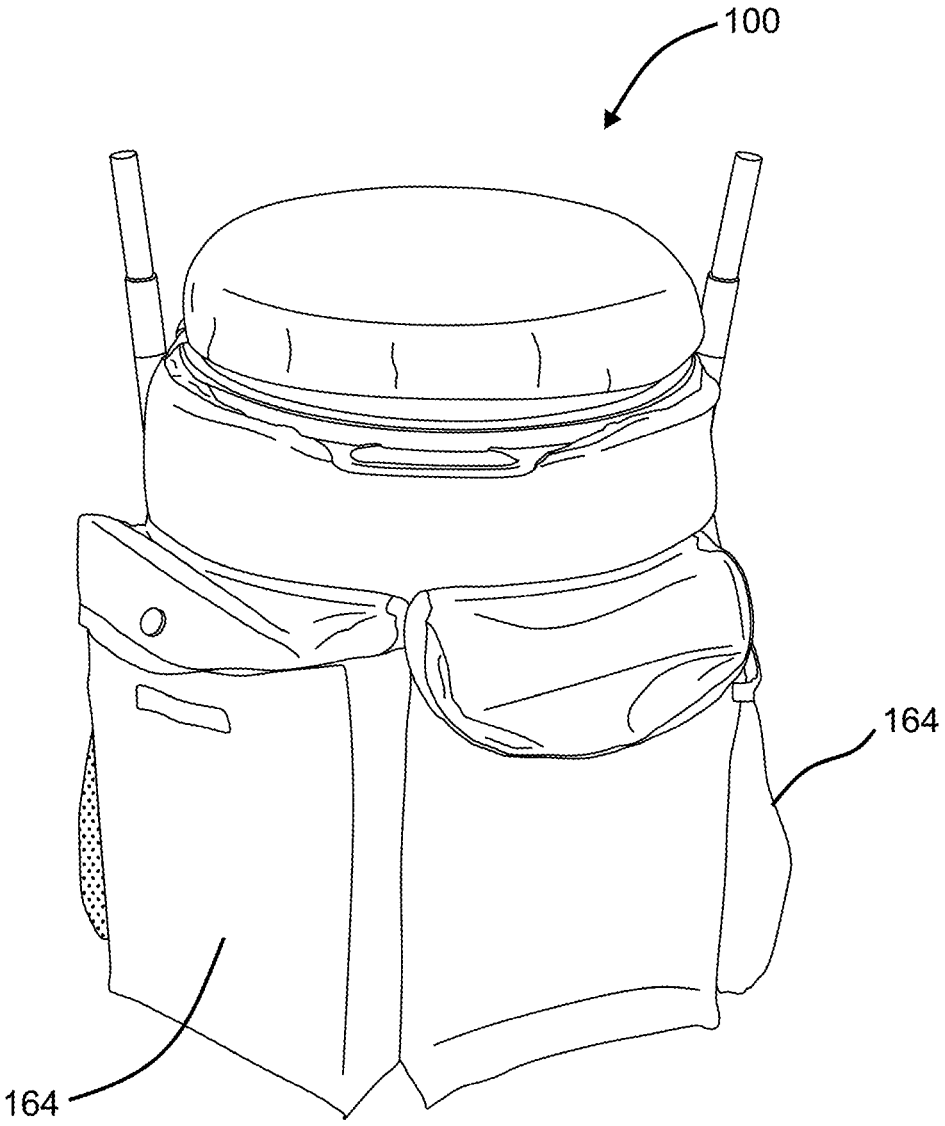
FIG. 2 is an alternate perspective view depicting the portable chair of FIG. 1 in the storage configuration, in accordance with an embodiment of the disclosure
Figure 4:
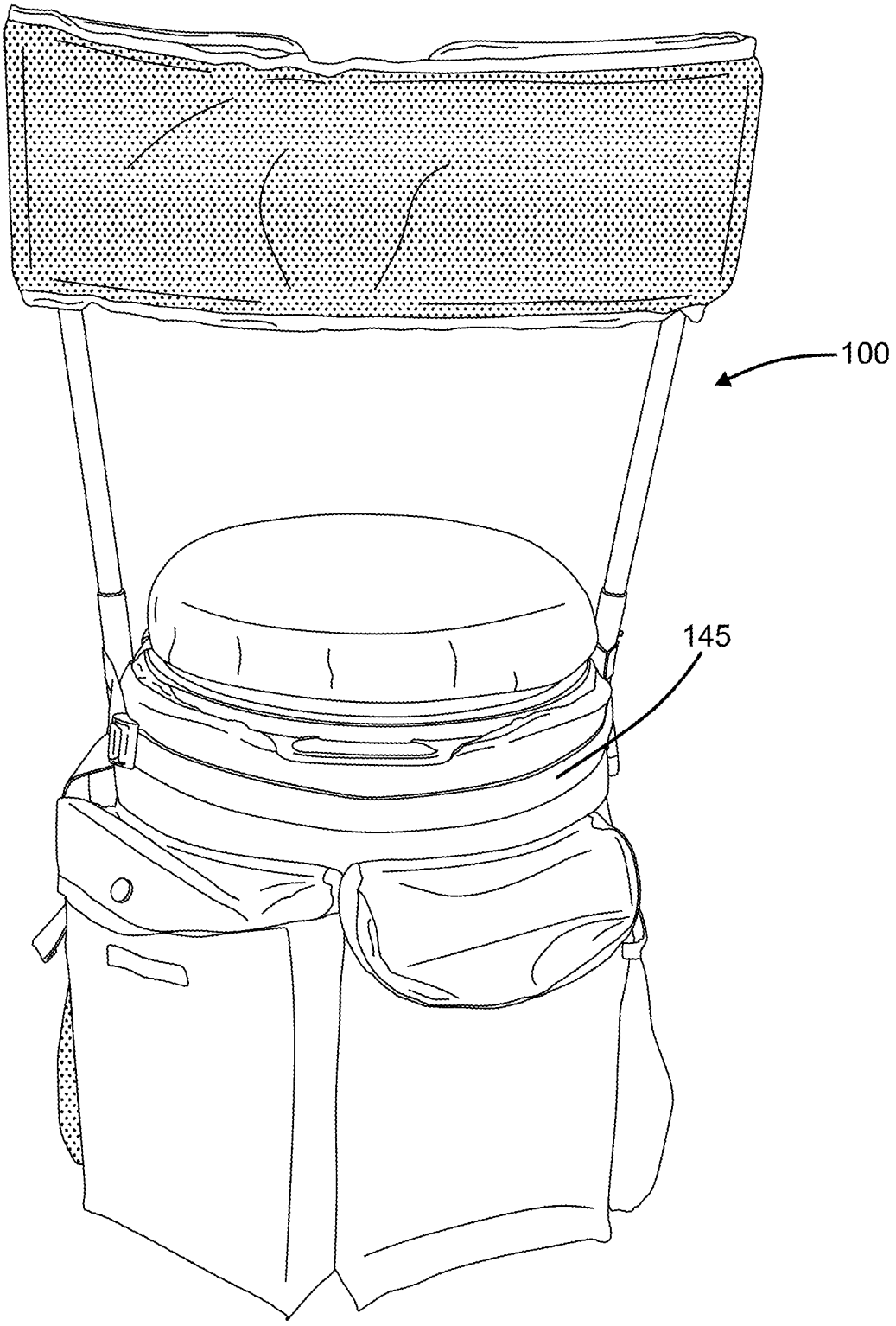
FIG. 4 is an alternate perspective view depicting the portable chair of FIG. 3 in the in use configuration, in accordance with an embodiment of the disclosure.

In operation, the portable chair 100 is transitionable from a first, backpack configuration (as depicted in FIGS. 1-2) to a second, seat configuration (as depicted in FIGS. 3-4). In the first, backpack configuration, the adjustable length padded hip belt 138 is coupled to the annular wall panel 112 via the one or more fasteners 140A/B and the pair of rigid telescoping poles 146A/B are in the shortened, storage configuration and positioned within the second pair of telescoping pole receiving pockets 144A/B positioned on the insulated fabric sheath 108. In the second, seat configuration, the pair of rigid telescoping poles 146A/B are extended to the lengthened, extended configuration, and the adjustable length padded hip belt 138 is decoupled from the annular wall panel 112, and the ends of the respective pair of rigid telescoping poles 146A/B are positioned within the first pair of telescoping pole receiving pockets 142A/B.

In one embodiment, an upper perimeter of the annular wall panel 112 includes a drawstring 150 enabling constriction of the upper perimeter around the top portion of the five gallon bucket 104. In one embodiment, the portable chair 100 can include a padded back support panel 156 operably coupled to the annular wall panel 112 between the pair of shoulder straps 132. In one embodiment, the portable chair 100 can include a fabric handle 158 operably coupled to the pair of shoulder straps 132 at an upper perimeter of the annular wall panel 112.

In one embodiment, the portable chair 100 can include a first pocket 160 (as depicted in FIG. 5) having a volume of at least about 50 cubic inches (about 820 cubic centimeters) operably coupled to the annular wall panel 112. In one embodiment, a portion of the annular wall panel 112 forms at least a portion of interior surface of the first pocket 160. In one embodiment, at least a portion of the first pocket 160 is constructed of a mesh fabric. In one embodiment, at least a portion of an upper perimeter of the first pocket 160 includes an elastic band.

Figure 15:
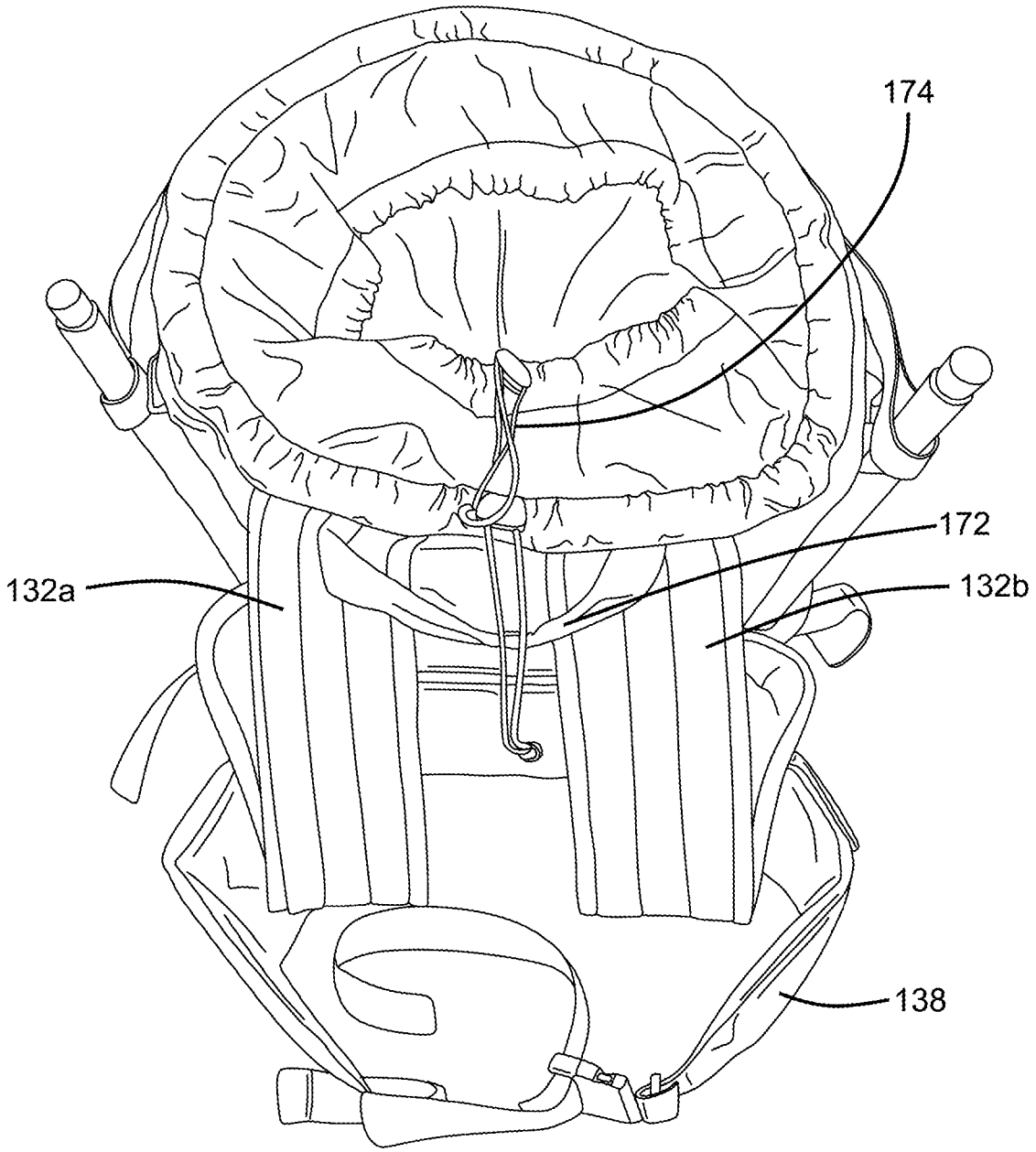
FIG. 15 is a perspective view depicting a portable chair including a first outer draw string and a second inner draw string and associated fabric configured to enable constriction of a top of an annular wall panel portion of the portable chair, in accordance with an embodiment of the disclosure.

In one embodiment, the portable chair 100 can include a second pocket 162 (as depicted in FIG. 5) having a volume of at least about 100 cubic inches (about 1640 cubic centimeters). operably coupled to the annular wall panel 112. In one embodiment, a portion of the an annular wall panel 112 forms at least a portion of an interior surface of the second pocket 162. In one embodiment, at least a portion of the upper perimeter of the second pocket 162 includes an elastic band or drawstring 172. As depicted in FIG. 15, in one embodiment, the portable chair 100 includes an outer drawstring 150 configured to enable a portion of the annular wall panel 112 to be constricted around the bucket 104, and a second, inner drawstring 174, with a corresponding portion of material, enabling a portion of the annular wall panel 112 to be constricted around (or over a top of) the lid 106 of the bucket 104. In some embodiments, the portable chair 100 is compatible with various sized buckets 104 (e.g., a 5 gallon bucket, a 6 gallon bucket, etc.) with the annular wall portion of the annular wall panel 112 configured to be constricted around the top of the lid 106 any type of compatible bucket 104.

In one embodiment, the portable chair 100 can include a third pocket 164 (as depicted in FIG. 1) having a volume of at least about 140 cubic inches (about 2300 cubic centimeters) operably coupled to the annular wall panel 112. In one embodiment, the third pocket 164 comprises a first panel representing three peripheral sides of the third pocket 164, and a second panel representing a front side of the third pocket 164. In one embodiment, a portion of the annular wall panel 112 forms at least a portion of an interior surface of the third pocket 164. In one embodiment, the third pocket 164 further includes a fabric lid selectively coupleable to the second panel to selectively close the third pocket 164. In one embodiment, the fabric lid includes a skirt configured to at least partially overlap with three sides of the third pocket 164. In one embodiment, the portable chair 100 includes a pair of third pockets 164 positioned on the annular wall panel 112 substantially opposite to the padded back support panel 156.

In one embodiment, fabric lid of the third pocket 164 is selectively coupleable to the second panel of the third pocket 164 with a two-part snap fastener. In one embodiment, a first part of the snap fastener is secured to the skirt of the fabric lid of the third pocket 164, and the second part of the snap fastener is secured to a snap panel operably coupled to the second panel of the third pocket 164, configured to aid in coupling of the two-part snap fastener. In one embodiment, the snap panel includes a first edge and a second edge operably coupled to the second panel of the third pocket 164, with the second part of the snap fastener positioned between the first edge in the second edge.

Having described the preferred aspects and implementations of the present disclosure, modifications and equivalents of the disclosed concepts may readily occur to one skilled in the art. However, it is intended that such modifications and equivalents be included within the scope of the claims which are appended hereto.

What is claimed is:

1. A portable chair, comprising:

a sealable plastic bucket including a lid;

an insulated fabric sheath comprising a bottom panel and an annular wall panel cooperating to form a cavity to receive the bucket, a seat portion pivotably coupleable to the lid of the bucket, the seat portion comprising a rigid panel including a centrally located threaded aperture, a seat pad, and a fabric panel at least partially enveloping the seat pad coupled to the rigid panel, wherein a threaded fastener passes through an aperture defined in the lid of the bucket for receipt in the threaded aperture of the rigid panel, thereby enabling the seat portion to pivot relative to the lid of the bucket;

a pair of shoulder straps operably coupled between an upper perimeter of the annular wall and a lower portion of the annular wall;

an adjustable length padded hip belt selectively coupleable to the annular wall panel via one or more fasteners, wherein the padded hip belt comprises a first pair of telescoping pole receiving pockets, each of the first pair of telescoping pole receiving pockets including a first telescoping pole receiving panel having a surface positioned against an exterior surface of the padded hip belt, and a second telescoping pole receiving panel operably coupled to the exterior surface of the padded hip belt about at least a portion of its peripheral edge to define each of the first pair telescoping pole receiving pockets;

a second pair of telescoping pole receiving pockets operably coupled to the annular wall, each of the pair of second telescoping pole receiving pockets including a first telescoping pole receiving panel having a surface positioned against an exterior surface of the annular wall, and a second telescoping pole receiving panel operably coupled to the exterior surface of the annular wall about at least a portion of a peripheral edge of the second telescoping pole receiving panel to define the second pair of telescoping pole receiving pockets; and a pair of rigid telescoping poles, each of the pair of rigid telescoping poles including a first member and a second member selectively coupleable together in at least one of an extended configuration and a storage configuration via a spring biased bayonet pin coupling, wherein the portable chair is transitionable from a first position in which the adjustable length padded hip belt is coupled to the annular wall panel via the one or more fasteners and the pair of rigid telescoping poles are in the storage configuration positioned within the second pair of telescoping pole receiving pockets, to a second configuration in which the pair of rigid telescoping pools are extended to the extended configuration, and the adjustable length padded hip belt is decoupled from the annular wall panel, and the ends of the respective pair of rigid telescoping poles are positioned within the first pair of telescoping pole receiving pockets.

2. The portable chair of claim 1, wherein an upper perimeter of the annular wall panel includes a drawstring enabling constriction of the upper perimeter around the top portion of the bucket.

3. The portable chair of claim 1, further comprising a pair of shoulder straps connectable between an upper perimeter of the annular wall and a lower portion of the annular wall.

4. The portable chair of claim 1, wherein each of the shoulder straps having a width of at least 3 inches.

5. The portable chair of claim 1, wherein the pair of shoulder straps are adjustable in length.

6. The portable chair of claim 1, wherein at least one of the pair of shoulder straps includes a D ring for selective gear attachment.

7. The portable chair of claim 1, further comprising an adjustable length chest strap including a first portion operably coupled to a first shoulder strap of the pair of shoulder straps, and a second portion operably coupled to a second shoulder strap of the pair of shoulder straps, wherein the first portion is selectively coupleable to the second portion.

8. The portable chair of claim 1, further comprising a padded back support panel operably coupled to the annular wall panel between the pair of shoulder straps.

9. The portable chair of claim 1, wherein the padded hip belt has a width of at least 6 inches.

10. The portable chair of claim 1, wherein each of the first pair of telescoping pole receiving pockets has a depth of at least 5 inches.

11. The portable chair of claim 1, further comprising a first pocket having a volume of at least 50 in.$^3$ operably coupled to the annular wall panel, wherein a portion of the annular wall panel forms at least a portion of interior surface of the first pocket, wherein at least a portion of the first pocket is constructed of a mesh fabric, and wherein at least a portion of an upper perimeter of the first pocket includes an elastic band.

12. The portable chair of claim 11, further comprising a second pocket having a volume of at least 100 in.$^3$ operably coupled to the annular wall panel, wherein a portion of the annual wall panel forms at least a portion of an interior surface of the second pocket, and wherein at least a portion of the upper perimeter of the second pocket includes an elastic band.

13. The portable chair of claim 12, further comprising a third pocket having a volume of at least 140 in.$^3$ operably coupled to the annular wall panel, wherein the third pocket comprises a first panel representing three peripheral sides of the third pocket, and a second panel representing a front side of the third pocket, wherein a portion of the annular wall panel forms at least a portion of an interior surface of the third pocket, and wherein the third pocket further comprises a fabric lid selectively coupleable to the second panel to selectively close the third pocket, the fabric lid comprising a skirt configured to at least partially overlap with three sides of the third pocket.

14. The portable chair of claim 13, wherein the portable chair includes a pair of third pockets positioned on the annular wall panel substantially opposite to the padded back support panel.

15. The portable chair of claim 13, wherein fabric lid is selectively coupleable to the second panel of third pocket with a two-part snap fastener, wherein a first part of the snap fastener is secured to the skirt of the fabric lid of the third pocket, and the second part of the snap fastener is secured to a snap panel operably coupled to the second panel of the third pocket, configured to aid in coupling of the two-part snap fastener.

16. The portable chair of claim 15, wherein the snap panel includes a first edge and a second edge operably coupled to the second panel of the third pocket, with the second part of the snap fastener positioned between the first edge in the second edge.

17. The portable chair of claim 1, further comprising a second pair of telescoping pole receiving pockets operably coupled to the annular wall, each of the pair of second telescoping pole receiving pockets including a first telescoping pole receiving panel having a surface positioned against an exterior surface of the annular wall, and a second telescoping pole receiving panel operably coupled to the exterior surface of the annular wall about at least a portion of a peripheral edge of the second telescoping pole receiving panel to define the second pair of telescoping pole receiving pockets.

18. The portable chair of claim 17, wherein each of the second pair of telescoping pole receiving pockets has a depth of at least 12 inches.

19. The portable chair of claim 1, further comprising a plurality of sliders positioned annularly around the threaded aperture of the rigid panel configured to enable ease in pivoting of the seat portion relative to the lid of the bucket.

20. The portable chair of claim 1, further comprising a seat portion securement strap enabling the seat portion to be selectively coupled to the annular wall portion.

* * * * *